United States Patent [19]

Shinkai

[11] Patent Number: 4,611,361

[45] Date of Patent: Sep. 16, 1986

[54] SHEET MATERIALS FOR CLEANING CONVEYING ROLLS AND GUIDES OF A FACSIMILE APPARATUS

[75] Inventor: Takashi Shinkai, Tokushima, Japan

[73] Assignees: Purely Hanbai Co., Ltd.; Awa Paper Manufacturing Co., Ltd., both of Tokushima, Japan

[21] Appl. No.: 709,287

[22] Filed: Mar. 7, 1985

[30] Foreign Application Priority Data

Mar. 9, 1984 [JP] Japan ..... 59-34401[U]

[51] Int. Cl.[4] ..... A47L 13/17

[52] U.S. Cl. ..... 15/104.93; 428/182

[58] Field of Search ..... 15/104.93; 428/182

[56] References Cited

U.S. PATENT DOCUMENTS

| | | | |
|---|---|---|---|
| 2,104,060 | 1/1938 | Spafford | 428/182 X |
| 2,394,855 | 2/1946 | Gould | 15/104.93 |
| 2,796,367 | 6/1957 | Brown | 15/104.93 X |
| 3,477,084 | 11/1969 | Thomas | 15/104.93 |
| 3,485,349 | 12/1969 | Chaney | 15/104.93 X |
| 3,734,277 | 5/1973 | Bucalo | 15/104.93 X |

FOREIGN PATENT DOCUMENTS

| | | | |
|---|---|---|---|
| 1961899 | 8/1971 | Fed. Rep. of Germany | 15/104/93 |
| 1144975 | 3/1969 | United Kingdom | 15/104.93 |

*Primary Examiner*—Chris K. Moore

*Attorney, Agent, or Firm*—Wenderoth, Lind & Ponack

[57] ABSTRACT

A sheet material for cleaning the surface of the paper conveying rolls and the inside surface of the guides of a facsimile apparatus, wherein the cleaning is performed by inserting said sheet material into the facsimile apparatus in place of the copy to be transmitted or the paper used for recording messages received, said sheet material being made up of an impregnated sheet and an absorbent sheet coupled to the rear end of said impregnated sheet, said impregnated sheet being characterized by having been impregnated with a cleaning fluid and having a sufficient stiffness such that it can be conveyed by the paper conveying rolls, as well as having a sufficient compressibility such that when the impregnated sheet is clasped between the paper conveying rolls and pressed, the cleaning fluid becomes squeezed out to adhere to the surface of the paper conveying rolls; and said absorbent sheet being characterized by having the function of absorbing the cleaning fluid that adheres to the surface of the paper conveying rolls, as well as having a structure enabling it to contact the inside surface of the conveying guides.

7 Claims, 8 Drawing Figures

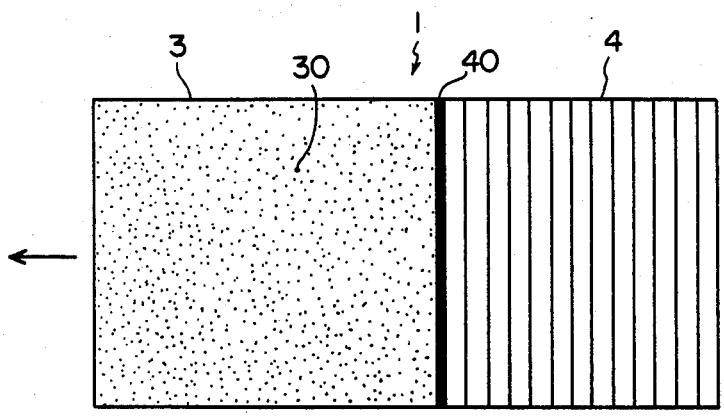
FIG. 1-A
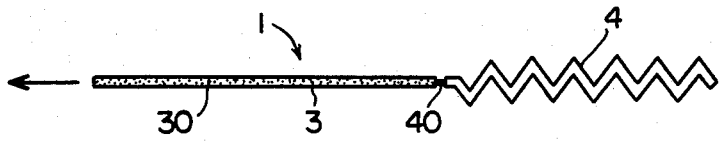
FIG. 1-B
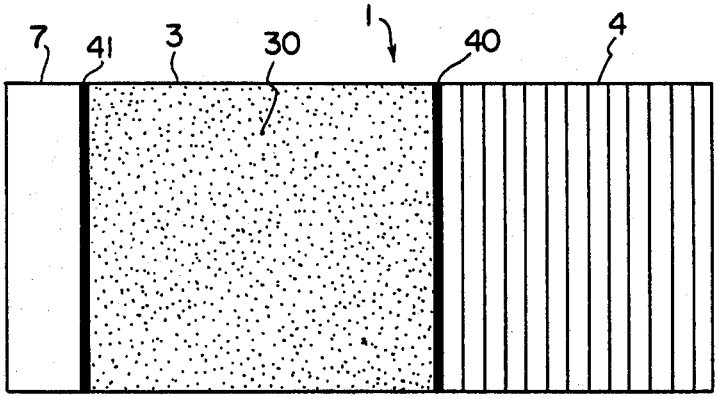
FIG. 2-A
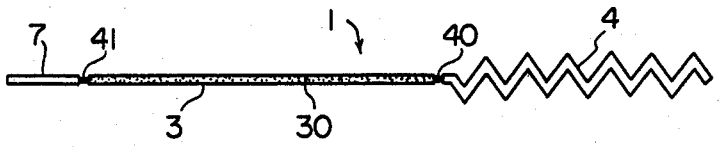
FIG. 2-B
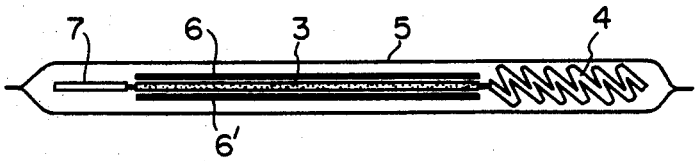
FIG. 2-C

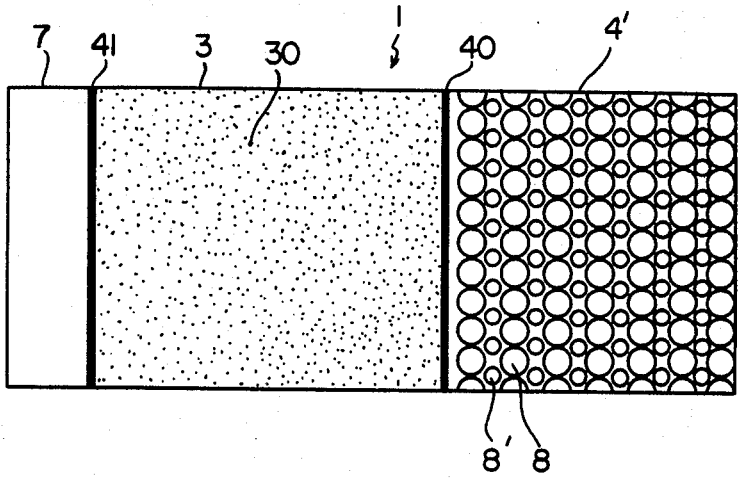
FIG. 3-A
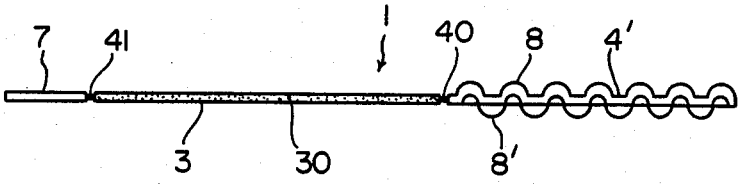
FIG. 3-B
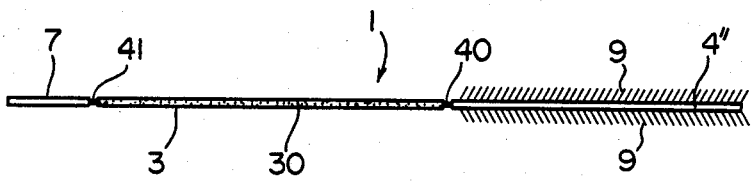
FIG. 4

SHEET MATERIALS FOR CLEANING CONVEYING ROLLS AND GUIDES OF A FACSIMILE APPARATUS

This invention relates to sheet materials to be used for cleaning the surface of paper conveying rolls and the inside surface of conveying guides of a facsimile apparatus, the cleaning being accomplished by the insertion of such a sheet into the apparatus in place of the copy to be transmitted or the paper on which the received message is to be recorded.

In a facsimile apparatus the copy to be transmitted is delivered into the apparatus by means of conveying rolls, and while the copy passes between the conveying guides the letters, characters, figures, diagrams, etc. are read, following which the copy is discharged externally of the apparatus by means of discharge rolls. On the other hand, in the case of the paper for recording received messages that is placed in advance in the facsimile apparatus, after having been recorded with the letters, characters, figures, diagrams, etc., that have been received, it s discharged externally of the apparatus. Naturally, these paper conveying rolls (hereinafter the delivery rolls and discharge rolls will simply be generically referred to as rolls or paper conveying rolls) during their use undergo soiling of their surfaces, which soil accumulates to invade at times the inside surface of the conveying guides. When the copy used for transmission and the paper on which received messages have been recorded are discharged from such an apparatus, the surface of these become soiled. For preventing such a situation, it has been the practice in the past to remove the soil by wiping the surfaces of the rolls and inside surface of the guides with a soft paper or rag impregnated with a cleaning fluid. It was however necessary in the case of such a method to disassemble the apparatus for exposing the rolls and guides. There was thus the drawback that time and labor were required.

It is therefore a primary object of this invention to provide a means of rapidly and easily cleaning the surface of the paper conveying rolls without the necessity of disassembling the facsimile apparatus.

A secondary object of this invention is to provide a means whereby not only the surface of the paper conveying rolls but also the inside surface of the conveying guides can be cleaned rapidly and easily.

As such a means, there is provided in accordance with this invention a sheet material comprising an liquid-impregnated sheet and an absorbent sheet coupled to the rear end of the liquid-impregnated sheet, said impregnated sheet being characterized by having been impregnated with a cleaning fluid and having a sufficient stiffness such that it can be conveyed by the paper conveying rolls, as well as having a sufficient compressibility such that when the impregnated sheet is clasped between the paper conveying rolls and pressed, the cleaning fluid becomes squeezed out and adheres to the surface of the paper conveying rolls; and said absorbent sheet being characterized by having the function of absorbing the cleaning fluid that adheres to the surface of the paper conveying rolls and having a structure enabling it to contact the inside surface of the conveying guides.

The sheet materials of this invention will now be specifically described by reference to the accompanying drawings, in which are shown preferred embodiments of the invention.

FIG. 1-A is a plan showing a most simple embodiment of the invention sheet materials; FIG. 1-B being a side view of the sheet material of FIG. 1-A.

FIG. 2-A is a plan showing an embodiment in which a minor change has been made in the sheet material of FIG. 1-A, FIG. 2-B being a side view of the sheet material of FIG. 2-A.

FIG. 2-C is a side view showing the state where the sheet material of FIG. 2-A has been hermetically wrapped in a transparent plastic film bag.

FIG. 3-A is a plan showing another embodiment of the invention sheet material; FIG. 3-B being a side view of the sheet material of FIG. 3-A.

FIG. 4 is a side view showing a still another embodiment of the invention sheet material.

For convenience in facilitating one's understanding of the structure of the sheet material, the side views mentioned hereinabove have been delineated on a magnified scale in the thickness direction of the sheet material.

The sheet material 1 shown in FIGS. 1-A and 1-B consists of an impregnated sheet 3 impregnated with a cleaning fluid 30 and a corrugated absorbent sheet 4, the two being coupled to each other by adhesion or fusion of the rear end of impregnated sheet 3 with the front end of the absorbent sheet 4 along the line 40.

When this sheet material is inserted into the nip between the delivery rolls of a facsimile apparatus in the same manner as a copy to be transmitted is inserted, first the impregnated sheet 3 becomes compressed by the delivery rolls, with the consequence that the cleaning fluid becomes squeezed out and adheres to the surface of the delivery rolls. Next, the corrugated absorbent sheet 4 passes through the gap between the delivery rolls in a flattened state, and at this time the cleaning fluid adhering to the surface of the delivery rolls becomes absorbed. The impregnated sheet 3 that has been released from between the nip of the delivery rolls is then inserted via conveying guides into the nip between the discharge rolls and, as described hereinabove, the cleaning fluid is squeezed out by being compressed by the discharge rolls and caused to adhere on these rolls, after which the impregnated 3 is discharged externally of the facsimile apparatus via the nip of the discharge rolls. On the other hand, when the absorbent sheet 4 that is coupled to the impregnated sheet 3 is released from the nip between the delivery rolls, it recovers its original corrugated state and is conveyed while wiping the inside surface of the conveyin guides. It then is inserted into the nip between the discharge rolls and, as described hereinabove, absorbs the cleaning fluid adhering to the surface of the discharge rolls while in a flattened state resulting from the compressive force of the rolls, after which it is discharged externally of the facsimile apparatus from between the nip of the discharge rolls. It thus becomes possible to easily clean the delivery rolls, conveying guides and discharge rolls by passing the sheet material of this invention at least once through the course through which the copy to be transmitted is passed through the facsimile apparatus. Similar results can be had when the invention sheet material is applied to the course through which the received message recording paper is passed.

As indicated hereinbefore, the impregnated sheet 3 must have a sufficient stiffness such that it can be conveyed by the paper conveying rolls, as well as a sufficient compressibility such that when the sheet has been clasped between the paper conveying rolls and pressed, the cleaning fluid becomes squeezed out and adheres to the surface of the paper conveying rolls. As materials for obtaining an impregnated sheet meeting these conditions, included are, for example paper, nonwoven fabrics, woven fabrics, plastic foams having continuous cells, etc. As the cleaning fluid, there can be mentioned, for example the freon-type detergents, lower alcohols, neutral detergents and water. Further, if an antistatic agent and/or an antifungal agent is added to these cleaning fluids, the paper conveying rolls can not only be cleaned but also be given an antistatic and/or antifungal treatment. While there is no particular restriction as to the dimensions of the impregnated sheet 3 so long as it conforms with the standard dimensions of the facsimile apparatus, usually the length is made longer than the outer peripheral length of the paper conveying rolls by say at least 10 centimeters, and preferably at least 15 centimeters. And the width is made about equal to the length of the paper conveying rolls in its axial direction, for example about 20 to 30 centimeters, while the thickness is made to be about 0.2 to 1 millimeter, preferably 0.3 to 0.6 millimeter, depending upon the amount of cleaning fluid required to be used and the desired compressibility.

The absorbent sheet 4, as indicated hereinbefore, must have as its first requisite a function enabling it to absorb the cleaning fluid adhering to the surface of the paper conveying rolls on its contact with the surface of the paper conveying rolls. As its second requisite, it must have such a structure as will enable it to make contact with the inside surface of the conveying guides. For meeting the first requisite, the absorbent sheet 4 is usually made of paper or a woven or nonwoven fabric. As a structure satisfying the second requisite, conceivable are various embodiments. As one embodiment, the absorbent sheet 4 shown in FIGS. 1-A and 1-B is of corrugated form. As described hereinbefore, the corrugated absorbent sheet 4 is temporarily flattened at the time it absorbs the cleaning fluid at the surface of the conveying rolls while being clasped between the nip of said rolls, but on its release from between the nip of the conveying rolls it recovers its original corrugated form and it is conveyed into between the nip of the discharge rolls in this state. The corrugated portion of the absorbent sheet 4 thus makes contact with the inside surface of the guides that are disposed between the conveying and discharge rolls, whereby the soil adhering to the inside surface of the guides is removed.

The sheet material shown in FIGS. 2-A and 2-B is of the same makeup as the sheet material shown in FIGS. 1-A and 1-B but with a leading sheet 7 coupled to its front end. The coupling of the leading sheet 7 to the impregnated sheet 3 is performed by adhesion or fusion of the rear end of the former with the front end of the latter along the line 41. The leading sheet 7 is made of a material stiffer than that of the impregnated sheet 3, such as a paper, nonwoven or woven fabric, plastics or films not impregnated with a cleaning fluid. The impregnated sheet 3, as described hereinbefore, has per se a sufficient stiffness such as will enable it to be conveyed by the paper conveying rolls, and it hence has such merits as that it can be rapidly passed through the course through which the copy to be transmitted or the received message recording paper passes through and that the surface of the rolls and the inside surface of the guides can be easily cleaned. These merits can however be achieved with greater certainty by providing a leading sheet 7 at the front end of the impregnated sheet 3 in accordance with the embodiment shown in FIGS. 2-A and 2-B.

The sheet material shown in FIGS. 3-A and 3-B is one in which the corrugated absorbent sheet 4 of paper, woven or nonwoven fabric, etc. has been replaced by an embossed absorbent sheet 4' of similar material (in the figure, for convenience in facilitating one's understanding of the structure, the bosses 8 and 8' are shown on an extremely magnified scale). The pattern of embossments 8, 8' is not restricted to that shown, and any will do so long as the absorbent sheet is one satisfying the following conditions. To wit, that the absorbent sheet has a shape and structure such as that when it is clasped between the nip of the rolls, it flattens and absorbs the cleaning fluid at the surface of the rolls and, when it is released from between said nip, it practically recovers its original form and makes contact with the inside surface of the guides.

The sheet material shown in FIG. 4 is the same as those shown in FIGS. 2-A, 2-B, 3-A and 3-B, except that there is used an absorbent sheet 4'' of a paper, woven or nonwoven fabric, etc. having a nap 9. Naturally, in this case also the absorbent sheet 4'' must be such that the nap 9 lies down when the sheet 4 is flattened by having been clasped between the nip of the rolls and, on the other hand, recovers its original state when the sheet 4'' has been released from between the nip of the rolls to enable the nap 9 to make contact with the inside surface of the guides.

The sheet materials of this invention are preferably stored in a sealed state when not being used for preventing the volatilization of the cleaning fluid 30 impregnated in the impregnated sheet 3. By way of example, there is shown in FIG. 2-C an embodiment wherein a strippable sheet 6, 6' of an impermeable plastic is adhered to both sides of the impregnated sheet 3, while the absorbent sheet 4 is folded compactly, and the whole sheet material is hermetically packaged in a transparent plastic bag 5. In certain cases, either the strippable sheet 6, 6' or the plastic bag 5 may be omitted.

The basic mechanism of the sheet materials of this invention, as described hereinbefore, consists in feeding a cleaning fluid from an impregnated sheet onto the surface of the paper conveying rolls followed by wiping off the cleaning fluid with an absorbent sheet that is coupled to said impregnated sheet, as well as conveying said absorbent sheet while causing it to contact the inside surface of the conveying guides. It thus becomes possible in accordance with this invention to clean the surface of the paper conveying rolls and the inside surface of the conveying guides rapidly without disassembling the facsimile apparatus but by simply passing through the course through which the copy to be transmitted or the receiving message recording paper are passed, in place of these papers, a sheet material of this invention. Hence, the surface of the paper conveying rolls and the inside surface of the conveying guides can constantly be kept in a clean state by the timely use of the sheet materials of this invention thereby preventing the adhesion of soil to the copy to be transmitted or the paper used for recording received messages.

What is claimed is:

1. A sheet material for cleaning the surface of the paper conveying rolls and the inside surface of the guides of a facsimile apparatus, wherein the cleaning is performed by inserting said sheet material into the facsimile apparatus in place of the copy to be transmitted or the paper used for recording messages received, said sheet material being made up of an impregnated sheet and an absorbent sheet coupled to the rear end of said impregnated sheet, said impregnated sheet being characterized by having been impregnated with a cleaning fluid and having a sufficient stiffness such that it can be conveyed by the paper conveying rolls, as well as having a sufficient compressibility such that when the impregnated sheet is clasped between the paper conveying rolls and pressed, the cleaning fluid becomes squeezed out to adhere to the surface of the paper conveying rolls; and said absorbent sheet being characterized by having the function of absorbing the cleaning fluid that adheres to the surface of the paper conveying rolls, as well as having a structure enabling it to contact the inside surface of the conveying guides.

2. A sheet material of claim 1 wherein the impregnated sheet is a member selected from the group consisting of paper, woven and nonwoven fabrics, and plastic foams having continuous cells, said member having been impregnated with an impregnator chosen from the group consisting of the freon-type detergents, lower alcohols, neutral detergents and water.

3. A sheet material of claim 1 wherein the absorbent sheet is a member selected from the group consisting of paper and woven and nonwoven fabrics.

4. A sheet material of claim 1 wherein the absorbent sheet is a member selected from the group consisting of corrugated paper and corrugated woven and nonwoven fabrics.

5. A sheet material of claim 1 wherein the absorbent sheet is a member selected from the group consisting of embossed paper and embossed woven and nonwoven fabrics.

6. A sheet material of claim 1 wherein the absorbent sheet is a member chosen from the group consisting of napped paper and napped woven and nonwoven fabrics.

7. A sheet material of claim 1 wherein a leading sheet is coupled to the front end of said impregnated sheet.

* * * * *